United States Patent [19]

Cook et al.

[11] 4,165,144

[45] Aug. 21, 1979

[54] LIGHT SOCKET WITH LEVER CONTACTS

[75] Inventors: Albert N. Cook, Madison; Boleslaw Kornatowski, Elizabeth; Raymond S. Tyburcy, Middletown, all of N.J.

[73] Assignee: The Singer Company, New York, N.Y.

[21] Appl. No.: 880,690

[22] Filed: Feb. 24, 1978

[51] Int. Cl.[2] ..... H01R 13/54; H01R 17/22

[52] U.S. Cl. ..... 339/88 R; 339/181 R; 339/189 L

[58] Field of Search ..... 339/88 R, 90 F, 181 R, 339/189 R, 255 L, 189 L

[56] References Cited

U.S. PATENT DOCUMENTS 2,443,743 6/1948 McNabb ..... 339/88 R 2,456,501 12/1948 Goble ..... 339/88 R

FOREIGN PATENT DOCUMENTS 1244364 9/1960 France ..... 339/88 R

*Primary Examiner*—Roy Lake
*Assistant Examiner*—E. F. Desmond
*Attorney, Agent, or Firm*—Robert E. Smith; Edward L. Bell; Edward W. Goodman

[57] ABSTRACT

A light socket for bayonet-type lamps in which the contacts therein are in the form of levers having one end formed to engage the contacts of a lamp inserted into the socket. The levers pivot on the electrically conductive tubes into which the ends of lead wires may be inserted for conducting electrical power to the levers.

1 Claim, 4 Drawing Figures

LIGHT SOCKET WITH LEVER CONTACTS

BACKGROUND OF THE INVENTION

This invention relates to light sockets, and in particular, those sockets adapted to receive bayonet-type lamps. Prior art sockets of this type use cantilevered leaf springs for providing electrical connection to the contact on the base of the lamp. While this arrangement perform its task with reasonable effectiveness, the electrical currents running through the contacts may, over time, adversely effect the spring rate of the contacts resulting in contact pressures inconsistent with accepted standards.

SUMMARY OF THE INVENTION

The object of this invention is to provide a bayonet-type socket in which the electrical current flowing through the contacts will not have an adverse effect on the contact pressure. This object is achieved by providing contacts in the form of rigid levers pivotally mounted within the housing. One end of each lever is formed to engage the contacts on a bayonet-type lamp while the other end is formed to engage a compression spring situated in a well within the housing. Electrical power is supplied to the levers through pivot tubes, capable of receiving lead wires, on which the levers are pivotally mounted. Arranged in this manner the compression springs are not in the path of current flow and as such are not adversely affected thereby.

DESCRIPTION OF THE DRAWING

With the above and additional objects and advantages in view as will hereinafter appear, the invention will be described with reference to the drawing of the preferred embodiment in which.

DESCRIPTION OF THE PREFERRED EMBODIMENT

Figure 2:
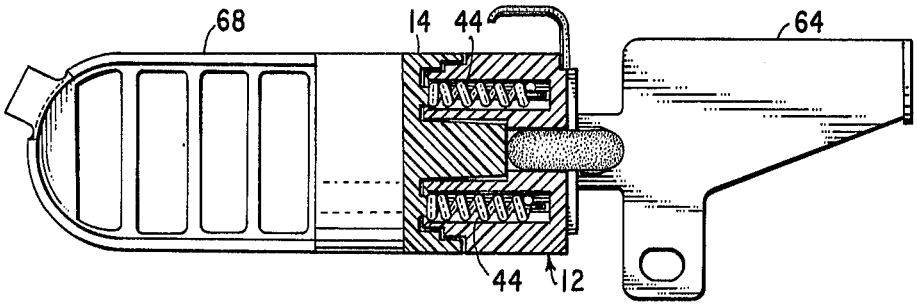
FIG. 2 is a front cross-sectional view of the socket, with the lamp removed, showing the mounting arrangement for the spring baising means.
Figure 1:
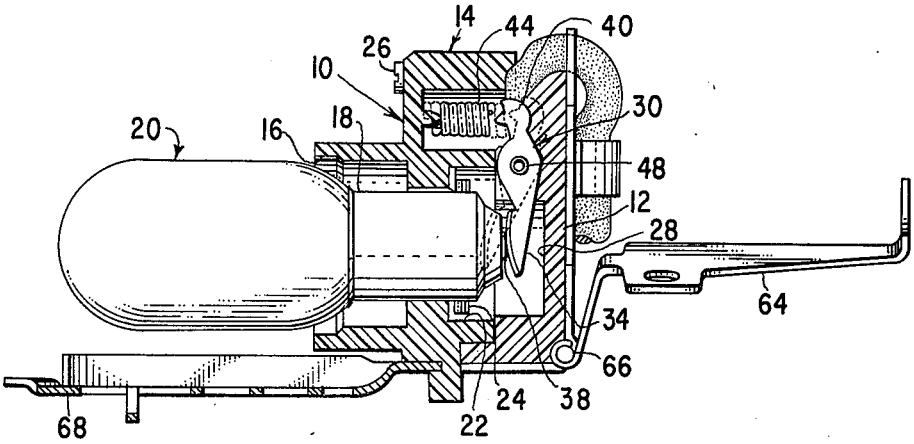
FIG. 1 is a side cross sectional view of a bayonet-type light socket, with a lamp in place, showing the invention incorporated therein.
Figure 3:
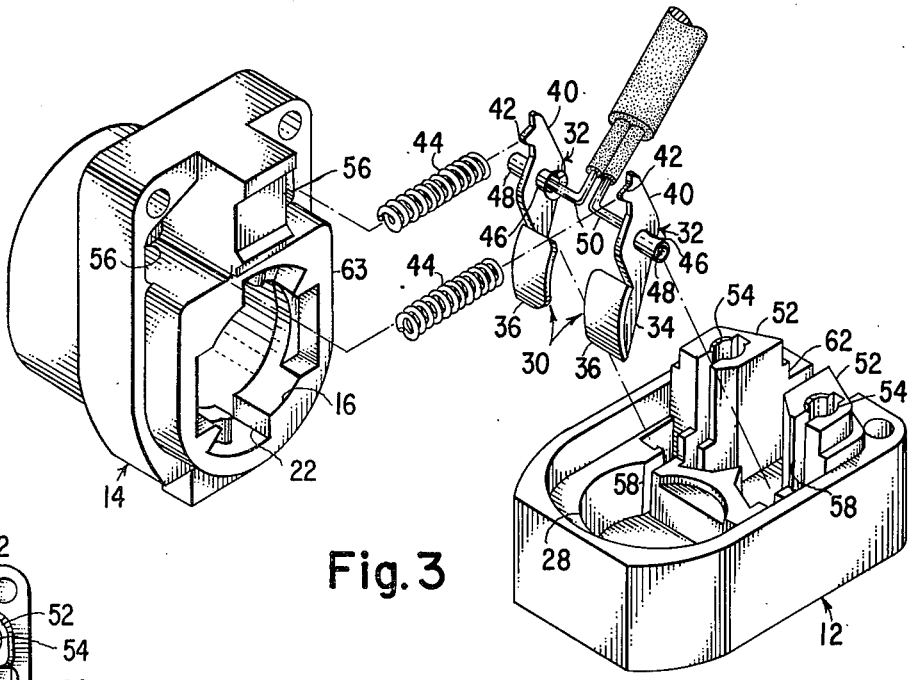
FIG. 3 is an exploded perspective view of the light socket showing the assembly of the invention therein.
Figure 4:
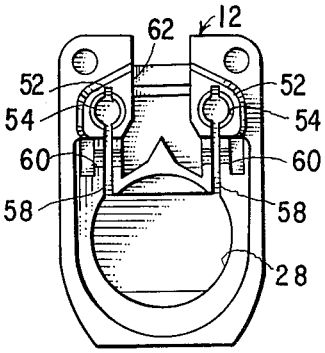
FIG. 4 is a top plan view of the housing base showing the recesses and grooves formed therein to contain the subject invention.

Referring to FIG. 1, a light socket assembly is generally referred to by the reference number 10. The socket 10 includes a two-part housing consisting of a base 12 and a lamp receiving portion 14. The lamp receiving portion 14 has a throughbore 16 therein for receiving the base 18 of a lamp 20. Two "J" shaped grooves 22 are formed on diametrically opposed side of the throughbore 16 for receiving pins 24 appending from the sides of the lamp base 18 such that the lamp 20 may be lockably retained therein. The lamp receiving portion 14 may be fastened to the housing base 12 by any suitable means, as, for example, screws 16. The housing base 12 is formed with a recess 28 which is in registry with the throughbore 16 when the base 12 and the lamp receiving portion 14 of the housing are fastened together. The recess 28 provide an area for receiving the contact assembly 30 of this invention.

The contact assembly 30 includes two levers 32 each having a first end 34 formed with a flat surface 36 for engaging contacts 38 on the lamp base 18 and a second end 40 having a projection 42 formed thereon for engaging compression springs 44. A hole 46 is formed in each of the levers 32 at the mid-points thereof through which pivot tubes 48 pass. One end of each of the pivot tubes 48 is flared for receiving the end of a lead wire 50.

The housing base 12 is formed with two vertically extending bosses 52 having holes 54 therein for receiving springs 44. When assembled, the bosses 52 are received by corresponding recesses 56 in the housing lamp receiving portion 14 which effectively capture springs 44 in the holes 54. Two slots 58 are formed in the housing base 12 intersecting the base recess 28 and extend one through each of the bosses 52 intersecting each of the holes 54 therein. The slots 58 accommodate the levers 32 allowing the first ends 34 thereof to extend into the recess 28 and the second ends 40 thereof to extend into the holes 54. "U" shaped grooves 60 are also formed in the housing base 12 and intersect the slots 58 midway between the base recess 28 and each of the bosses 52 for accommodating the pivot tubes 48. A channel 62 is formed in the housing base 12 midway between the bosses 52 to allow passage of the lead wire 50. The housing lamp receiving portion 14 is formed with a surface 63 which, when the housing lamp receiving portion 14 is fastened to the base 12, captures the contact assembly 30 in position.

A mounting bracket 64 is shown pivotally mounted to the housing base 12 at 66. A lamp shield 68, affixed to the housing lamp receiving portion 14, may also be provided.

Numerous alternations of the structure herein disclosed will suggest themselves to those skilled in the art. However, it is to be understood that the present disclosure relates to a preferred embodiment of the invention which is for the purposes of illustration only and not to be construed as a limitation of the invention. All such modifications which do not depart from the spirit of the invention are intended to be included within the scope of the appended claims.

Having thus set forth the nature of the invention, what we claim herein is:

1. A light socket for bayonet-type lamps comprising:

a lamp receiving portion having an opening therethrough for receiving said lamp;

means for lockably retaining said lamp in said opening;

a base mountable to said lamp receiving portion for closing one end of said opening, said base having a recess formed therein, and said base formed with at least one hollow boss arranged alongside of said lamp receiving portion when said base is mounted to said lamp receiving portion, with said recess in registry with said opening;

lever means formed of an electrically conductive material having one end thereof extending into said base recess to engage an electrical contact on said lamp and an opposite end extending into said hollow boss, fulcrum means for said lever carried in said second housing between said recess and said hollow boss;

connecting means for providing electrical power to said lever means; and compression spring means constrained in said hollow boss for engagement with the opposite end of said lever means for urging said contact engaging end of said lever means into said opening in said lamp receiving portion whereby, when said lamp is inserted into said opening, said contact engaging end of said lever means will physically engage an electrical contact on said lamp.

* * * * *